US010139129B2

(12) United States Patent
Yin et al.

(10) Patent No.: US 10,139,129 B2
(45) Date of Patent: Nov. 27, 2018

(54) WATER HEATER HAVING THERMAL DISPLACEMENT CONDUIT

(71) Applicant: A. O. SMITH CORPORATION, Milwaukee, WI (US)

(72) Inventors: Jianmin Yin, Racine, WI (US); Matthew Critchley, Milwaukee, WI (US)

(73) Assignee: A. O. Smith Corporation, Milwaukee, WI (US)

( * ) Notice: Subject to any disclaimer, the term of this patent is extended or adjusted under 35 U.S.C. 154(b) by 50 days.

(21) Appl. No.: 15/124,166

(22) PCT Filed: Mar. 13, 2015

(86) PCT No.: PCT/US2015/020395

§ 371 (c)(1),
(2) Date: Sep. 7, 2016

(87) PCT Pub. No.: WO2015/138864

PCT Pub. Date: Sep. 17, 2015

(65) Prior Publication Data

US 2017/0167752 A1 Jun. 15, 2017

Related U.S. Application Data

(60) Provisional application No. 61/953,349, filed on Mar. 14, 2014.

(51) Int. Cl.
*F24H 1/20* (2006.01)
*F24H 1/18* (2006.01)
(Continued)

(52) U.S. Cl.
CPC ..... *F24H 1/188* (2013.01); *F24H 1/0018* (2013.01); *F24H 1/0054* (2013.01); *F24H 1/202* (2013.01); *F24H 9/126* (2013.01)

(58) Field of Classification Search
CPC ..... F24D 19/0092; F24H 1/0018; F24H 1/20; F24H 1/50
See application file for complete search history.

(56) References Cited

U.S. PATENT DOCUMENTS 4,286,573 A * 9/1981 Nickel ..... F24H 9/124 122/14.31
4,777,347 A * 10/1988 Mottershead ..... F24H 1/202 122/19.1

(Continued)

FOREIGN PATENT DOCUMENTS

GB 871333 6/1961
GB 1394204 A * 5/1975 ..... F24H 9/124

(Continued)

OTHER PUBLICATIONS doityourself.com, "Leaking WH relief valve," [online forum]; Jan. 5, 2013, http://www.doityourself.com/forum/water-heathers/485174-leaking-wh-relief-valve-water -pouring-drainage-pipe-near-c-outside.html, 12 pages.

(Continued)

*Primary Examiner* — Gregory A Wilson
(74) *Attorney, Agent, or Firm* — Michael Best & Friedrich LLP

(57) ABSTRACT

A water heater includes a tank containing water to be heated and a thermal displacement conduit communicating between a portion of the tank and a receptacle. Water is displaced out of the portion of the tank, through the conduit, and to the receptacle during thermal expansion of the water during heating.

18 Claims, 5 Drawing Sheets

(51) Int. Cl.
*F24H 9/12* (2006.01)
*F24H 1/00* (2006.01)

(56) References Cited

U.S. PATENT DOCUMENTS

| | | | | |
|---|---|---|---|---|
| 4,930,551 | A | 6/1990 | Haws | |
| 4,949,680 | A * | 8/1990 | Kale | F24H 1/205 122/19.1 |
| 4,964,394 | A * | 10/1990 | Threatt | F24H 9/124 122/14.31 |
| 5,169,291 | A * | 12/1992 | Zebuhr | F04B 9/115 122/14.3 |
| 5,495,551 | A | 2/1996 | Robinson, Jr. et al. | |
| 5,690,061 | A | 11/1997 | Lopez | |
| 6,302,063 | B1 * | 10/2001 | Schimmeyer | F24H 9/126 122/14.3 |
| 6,370,328 | B1 * | 4/2002 | Mottershead | F24H 1/202 126/639 |
| 6,532,906 | B1 * | 3/2003 | Knoeppel | F24H 9/124 122/13.3 |
| 6,920,844 | B1 * | 7/2005 | Ismert | F24H 1/188 122/14.3 |
| 9,068,767 | B2 * | 6/2015 | Lesage | F25B 25/005 |
| 2005/0189431 | A1 | 9/2005 | Nakayama et al. | |
| 2007/0114297 | A1 * | 5/2007 | Burningham | F24H 9/126 237/19 |
| 2010/0037888 | A1 * | 2/2010 | Gordon | F24D 11/003 126/609 |
| 2013/0340690 | A1 * | 12/2013 | Rodriguez | F24H 1/181 122/19.2 |
| 2015/0377497 | A1 * | 12/2015 | Haws | F24D 17/0078 137/337 |

FOREIGN PATENT DOCUMENTS

| | | |
|---|---|---|
| GB | 2333145 | 7/1999 |
| JP | 2004218996 | 8/2004 |

OTHER PUBLICATIONS

Sherman, "You've got a dirty probe," website article, Mar. 19, 2012, 6 pages http://blog.allareaplumbing.net/blog/youve-got-a-dirty-probe.

PCT/US2015/020395 International Search Report and Written Opinion of the International Searching Authority dated Jun. 22, 2015 (12 pages).

PCT/US2015/020395 International Preliminary Report on Patentability dated Sep. 14, 2016 (1 page).

* cited by examiner

WATER HEATER HAVING THERMAL DISPLACEMENT CONDUIT

BACKGROUND

The present invention relates to a water heater having a thermal displacement conduit to accommodate thermal expansion of water during heating.

In traditional tank water heaters, water expands during heating and is forced out of the dip tube into the cold water inlet and cold water supply pipe. The water in the dip tube may be relatively warm because it extends vertically through the water column and heat gradients in the tank. Thus, warm water is displaced out of the tank during standby heating. This can lead to energy losses.

SUMMARY

In one configuration, the invention provides a water heater comprising: a tank containing water to be heated; a cold water inlet for interfacing between a cold water supply pipe and the water tank for the supply of cold water to the tank; a heat source for heating the water in the tank; a receptacle; and a thermal displacement conduit communicating between a portion of the tank and the receptacle, such that water is displaced from the portion of the tank, through the conduit, to the receptacle during thermal expansion of the water during heating.

In some configurations, the receptacle is a portion of the cold water inlet. In some configurations, the cold water inlet includes a check valve preventing water from displacing out of the tank through the cold water inlet. In some configurations, the heat source includes at least one electric heating element. In some configurations, the heat source includes a gas-fired burner. In some configurations, the portion of the tank is a portion containing relatively low-temperature water. In some configurations, the portion of the tank is a lower portion of the tank and the water displaced by thermal expansion through the thermal displacement conduit is water from the lower portion of the tank. In some configurations, the tank includes a drain valve assembly for draining water from the tank; wherein the thermal displacement conduit communicates between the drain valve assembly and the cold water inlet for delivery of displaced water from the drain valve assembly to the cold water inlet. In some configurations, at least a portion of the thermal displacement conduit is outside of the tank.

In some configurations, the water heater further comprises a jacket around the tank, the jacket and tank defining therebetween an annular space; and a layer of insulation in the annular space; wherein at least a portion of the thermal displacement conduit is within the annular space. In some configurations, the water heater further comprises a jacket around the tank, the jacket and tank defining therebetween an annular space; and a layer of insulation in the annular space; wherein at least a portion of the thermal displacement conduit is outside of the water heater, annular space and jacket. In some configurations, the water heater further comprises a dip tube extending from the cold water inlet into the tank for the delivery of cold water from the cold water inlet to a lower portion of the tank; and wherein the thermal displacement conduit is substantially contained in the dip tube.

In some configurations, the water heater further comprises a check valve ball positioned in the cold water inlet; wherein the check valve ball includes a bore; wherein the thermal displacement conduit communicates with the bore; wherein the check valve ball permits water to flow into the tank from the cold water inlet but prevents water from flowing out of the tank through the cold water inlet except from the thermal displacement conduit.

In another configuration of the invention, a water heater comprises a tank containing water to be heated; a cold water inlet for interfacing between a cold water supply pipe and the water tank for the supply of cold water to the tank; a dip tube communicating at one end with the cold water inlet and having an opposite free end from which cold water is released into the tank; a heat source for heating the water in the tank; a receptacle outside of the tank; and a thermal displacement conduit communicating between a portion of the tank and the receptacle, such that water is displaced from the portion of the tank, through the conduit, to the receptacle during thermal expansion of the water during heating; wherein the thermal displacement conduit is separate and distinct from the dip tube; and wherein the portion of the tank is lower than the free end of the dip tube.

In some configurations, water displaced to the receptacle flows back to the tank through the dip tube or the thermal displacement conduit when water is drawn from the tank. In some configurations, the cold water inlet includes a check valve for preventing water from flowing out of the tank through the cold water inlet during ordinary operation of the water heater; and wherein the thermal displacement conduit bypasses the check valve to displace water to the receptacle. In some configurations, the cold water inlet includes a check valve including a ball and a seat against which the ball sits to prevent flow of water from the tank through the cold water inlet during ordinary operation of the water heater; and wherein the thermal displacement conduit extends through the ball in the check valve to bypass the check valve. In some configurations, the thermal displacement conduit is external to the water tank.

Other aspects of the invention will become apparent by consideration of the detailed description and accompanying drawings.

DETAILED DESCRIPTION

Before any configurations of the invention are explained in detail, it is to be understood that the invention is not limited in its application to the details of construction and the arrangement of components set forth in the following description or illustrated in the following drawings. The invention is capable of other configurations and of being practiced or of being carried out in various ways.

Figure 1:
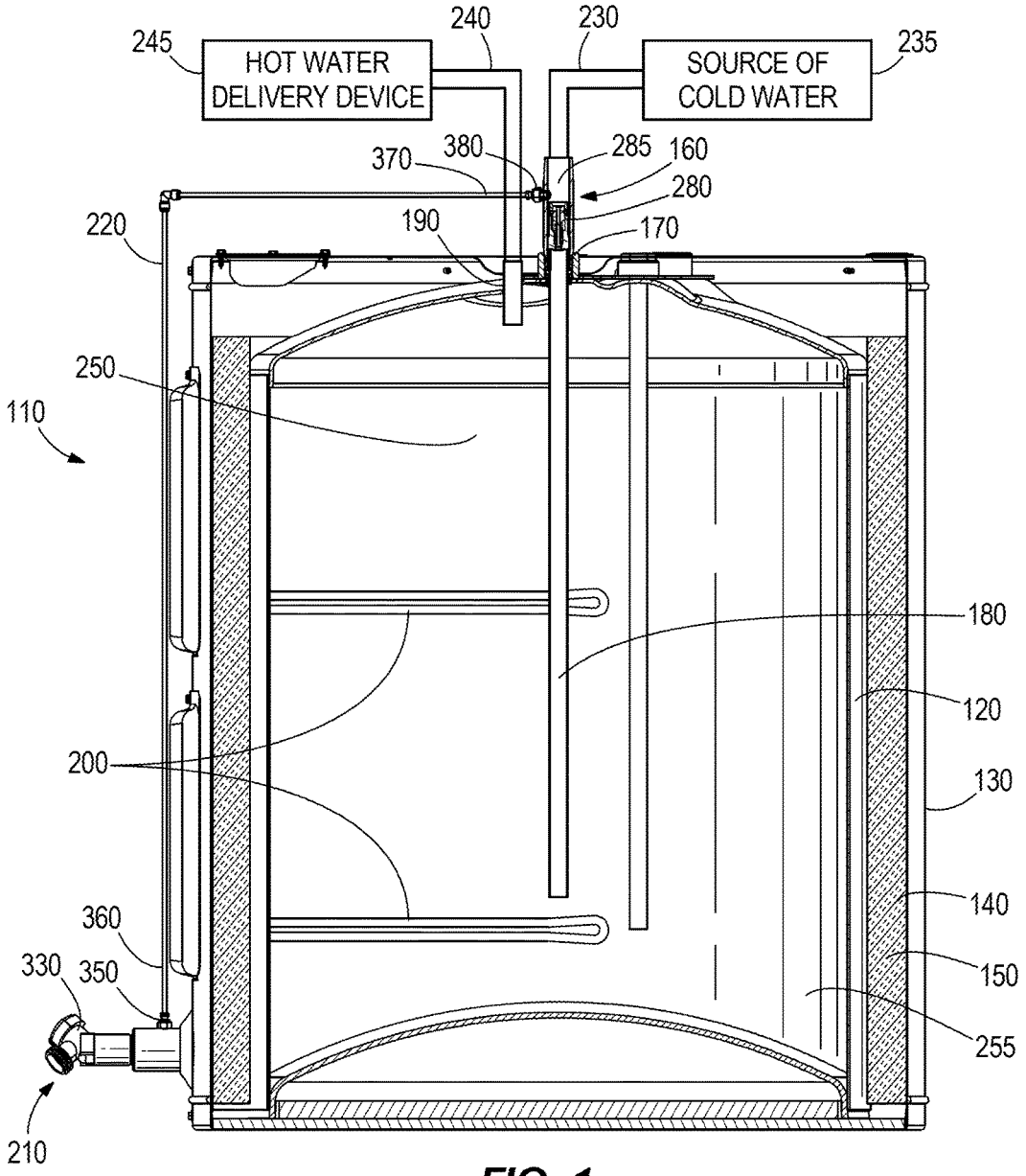
FIG. 1 is a cross-sectional view of a water heater incorporating a first configuration of a thermal expansion conduit according to the present invention.

FIG. 1 illustrates a water heater 110 comprising a tank 120 for holding water to be heated, a jacket 130 around the tank 120, a layer of insulation 140 in an annular space 150 between the tank 120 and jacket 130, a cold water inlet assembly 160, an inlet spud 170, a dip tube 180, a hot water outlet 190, a single or a pair of electric heating elements 200, a drain valve assembly 210, and a thermal displacement conduit 220. The tank 120 includes an upper portion 250 and a lower portion 255, which may alternatively be referred to as the respective top and bottom of the tank 120. A cold water supply pipe 230 communicates between a source of cold water 235 and the cold water inlet assembly 160 and a hot water supply pipe 240 communicates between a hot water consuming device 245 (e.g., a faucet, shower, or appliance) and the hot water outlet 190.

The cold water inlet assembly 160 includes a pipe nipple 260 (FIG. 2) that threads into the inlet spud 170 and which is also connected to the cold water supply pipe 230 by a threaded connection. The inlet spud 170 is welded or otherwise rigidly mounted to the top head of the water heater tank 120. The cold water inlet assembly 160 interfaces between the cold water supply pipe 230 and the water tank 120 for the supply of cold water to the tank 120. The pipe nipple could be made from steel, stainless steel, plastic or other materials; the connection between nipple and cold water supply pipe could be by using quick compression fitting.

The cold water inlet assembly 160 further includes a check valve assembly 280 in the pipe nipple 260. The check valve assembly 280 permits the flow of cold water from the cold water supply pipe 230 into the tank 120 through the cold water inlet assembly 160, but blocks the flow of water from the tank 120 to the cold water supply pipe 230 through the cold water inlet assembly 160 during ordinary operation of the water heater 110. The cold water inlet assembly 160 also includes a space that may be referred to as a receptacle 285 above (i.e., in an upstream direction from the cold water inlet 160 toward the source of cold water 235) the check valve assembly 280.

The dip tube 180 includes an upper end communicating with the cold water inlet assembly 160 and an opposite free end in the tank 120. The dip tube 180 is positioned in the inlet spud 170 to receive cold water from the cold water inlet assembly 160. The cold water flows out of the free end of the dip to into the lower portion 255 of the tank 120. In all illustrated configurations of the invention, the thermal displacement conduit communicates with a portion of the tank 120 lower than the free end of the dip tube 180. Also in all illustrated configurations, the thermal displacement conduit is separate and distinct from the dip tube 180.

The electric heating elements 200 are energized with electricity to heat the water in the tank 120. The illustrated configuration is an electric storage water heater, but the invention would apply to a gas-fired storage water heater in which a gas burner is positioned adjacent the tank 120 and products of combustion produced by the gas burner are used to heat the water in the tank 120 through a flue. The invention may also utilize a condenser coil of a heat pump to heat the water. The invention may also utilize the waste heat from another device to heat the water. The electric heating elements 200, gas burner, condenser coil, waste heat and any other component useful in heating water in a storage-type water heater can be collectively referred to as a "heat source."

The hot water outlet 190 communicates with an upper portion 250 or top of the tank 120, where the hottest water in the tank 120 naturally rises due to convention. When the hot water consuming device 245 is opened, cold water flows into the lower portion 255 of the tank 120 through the dip tube 180 under the water pressure of the source of cold water 235, and displaces hot water out of the upper portion 250 of the tank 120 through the hot water outlet 190 and the hot water supply pipe 240, and to the hot water consuming device 245.

The drain valve assembly 210 communicates with the lower portion 255 of the water tank 120. A valve mechanism 330 in the drain valve assembly 210 can be opened to drain water from the tank 120. In the configuration of FIG. 1, the drain valve assembly 210 includes a fitting 350 (e.g., a quick connect fitting, a threaded fitting, a permanent attachment fitting, or a tamper resistant fitting) to receive an end of the thermal displacement conduit 220. The fitting 350 is between the valve mechanism 330 and the tank 120, such that the fitting 350 always communicates with water in the tank 120, without regard to whether the valve mechanism 330 is open or closed. In other configurations, the thermal displacement conduit 220 may communicate with the lower portion 255 of the tank 120 through a spud or other fitting that is separate from the drain valve assembly 210 and extends through the tank wall.

The thermal displacement conduit 220 communicates between the lower portion 255 of the tank 120 and the receptacle 285. More specifically, in the configuration of FIG. 1, the thermal displacement conduit 220 communicates at one end 360 with water in the lower portion 255 of the tank 120 through the fitting 350, and at an opposite end 370 with the receptacle 285 in the cold water inlet assembly 160 through a fitting 380 that may be similar or identical to the fitting 350. The fitting 380 communicates with a portion of the cold water inlet assembly 160 (e.g., the receptacle 285, as explained below) above the check valve assembly 280. As such, the thermal displacement conduit 220 bypasses the check valve assembly 280 and communicates between the lower portion 255 of the tank 120 and the cold water supply pipe 230 (via the receptacle 285) regardless of whether the check valve assembly 160 is open or closed. The invention is not limited to the receptacle 285 being in the cold water inlet assembly 160 or the cold water supply pipe 230; the receptacle 285 may be separate from those components. The receptacle 285 is outside of the water tank 120.

In the configuration of FIG. 1, there is no check valve in the thermal displacement conduit 220; water may travel freely in both directions through the thermal displacement conduit 220. During a hot water draw, when cold water flows into the tank 120 through the cold water inlet assembly 160, some of the cold water may flow through the thermal displacement conduit 220, through the drain valve assembly 210, and into the lower portion 255 of the tank 120. A check valve or heat trap device may be positioned within the thermal displacement conduit 220 if desired, to permit flow only in the direction from the drain valve assembly 210 to the receptacle 285 or to reduce convection along this conduit.

In the configuration of FIG. 1, the majority of the thermal displacement conduit 220 is outside of the water heater jacket 130. In other configurations, the thermal displacement conduit 220 may be mostly positioned within the annular space 150 between the tank 120 and jacket 130, or may be positioned within the tank 120. The diameter of the thermal displacement conduit 220 is selected to permit water to be displaced from the tank 120 during heating at an expected rate based on the rate at which the water is expected to be heated by the heating elements 200. If the diameter is too small, undesirable pressure may build up in the tank 120. If the diameter is too large, more water will flow into the tank 120 through the thermal displacement conduit 220 during hot water draws, and increase the chance of convections inside the conduit 220. Conceptually, if the thermal displacement conduit 220 is given a sufficiently large diameter, the thermal displacement conduit 220 could be used as the cold water inlet (i.e., plumb the cold water inlet through the tank wall via the drain valve 210 or another spud in the lower portion 255 of the tank 120), eliminating the need for the cold water inlet assembly 160 and the dip tube 180, but this may not be desirable from a plumbing installation perspective. The thermal displacement conduit 220 may be made of plastic, steel, stainless steel, copper or any other suitable material for the configuration.

After hot water is drawn from the tank 120, the water in the tank 120 is usually relatively cool due to the cold water displacing the hot water that has been drawn, and may be below the water temperature set-point for the water heater 110. The control system of the water heater 110 energizes the heating elements 200 (or other source of heat) to heat the water to the desired set-point. The water expands as it is heated during this standby heating period. The check valve assembly 280 blocks the thermal displacement of water out of the cold water inlet assembly 160, and the closed hot water consuming device 245 prevents the thermal displacement of water out of the hot water outlet 190. Consequently, in the configuration of FIG. 1, the path of least resistance for water being displaced during standby heating is through the thermal displacement conduit 220. More specifically, water is displaced from the lower portion 255 of the tank 120 (which is typically the coolest or relatively low-temperature water in the tank 120), into the drain valve assembly 210 and thermal displacement conduit 220, and into the receptacle 285.

In other configurations, the thermally displaced water could be displaced into a receptacle outside of the cold water inlet assembly 160. The term "receptacle" is intended to broadly cover the receptacle 285, a receptacle or an accumulator separate from the cold water inlet assembly 160, and any other destination for the thermally displaced water. In this regard, the thermal displacement conduit 220 communicates between a portion of the tank 120 and the receptacle 285, such that water is displaced from the portion of the tank 120, through the conduit 220, to the receptacle 285 during thermal expansion of the water during heating. The receptacle 285 is preferably part of the closed system of the water heater, meaning that the displaced water is returnable to the tank 120 from the receptacle 285. Water displaced to the receptacle flows back to the tank 120 through the dip tube 180 or the thermal displacement conduit when water is drawn from the tank 120.

Figure 2:
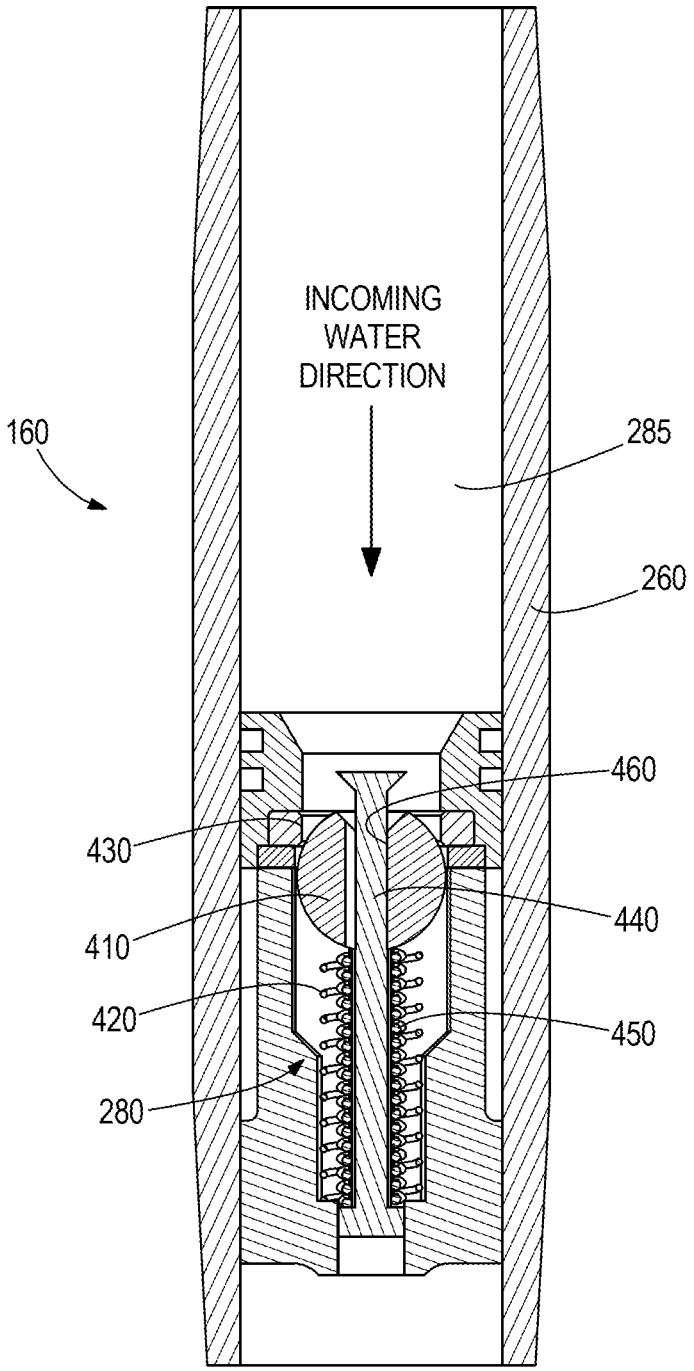
FIG. 2 is a cross-sectional view of a check valve assembly for use with the first expansion conduit configuration.

FIG. 2 illustrates a first configuration of the check valve assembly 280. The check valve assembly 280 is housed in the pipe nipple 260. The check valve assembly 280 includes a ball 410, a main spring 420 biasing the ball 410 into engagement with a check valve seat 430, a relief valve 440, and a relief valve spring 450. The ball 410 can alternatively be a floating or thermally reactive ball that seats when water below it reaches a particular temperature, and, in this regard, the check valve assembly 280 can also function as a heat trap. Such heat trap ball resists or prevents thermal energy from flowing via convection out of the tank 120 through the cold water inlet assembly 160 and cold water supply pipe 230.

In the seated position, the ball 410 resists or prevents the flow of water out of the water inlet assembly 160 from the tank 120. When water is drawn from the tank 120, the difference in water pressure above and below the check valve assembly 280 deflects the main spring 420 and unseats the ball 410 so the cold water can flow around it. The check valve assembly 280 substantially or entirely prevents the flow of water out of the tank 120 through the water heater inlet assembly 160 during ordinary operation of the water heater 110.

The relief valve 440 is positioned within a through-bore 460 in the ball 410 and is biased into a seated position (i.e., biased down in FIG. 2 to close the through-bore 460) under the influence of the relief valve spring 450. Under ordinary operation, the relief valve 440 stays in the seated position such that water does not flow through the through-bore 460. In the event the thermal displacement conduit 220 is blocked or restricted, and pressure in the tank 120 exceeds a desired level due to thermal expansion of water in the tank 120, pressure on the relief valve 440 results in a force that overcomes the biasing force of the relief valve spring 450. With the relief valve 440 unseated, water can flow out of the tank 120 and through the cold water inlet assembly 160 via the through-bore 460 in the ball 410. The relief valve 440 may be calibrated so that it unseats at a pressure that is below a pressure that would activate a traditional pressure relief valve on the water tank 120 which may also be present in the water heater 110 to dump water from the tank 120 at a certain pressure threshold.

Figure 3:
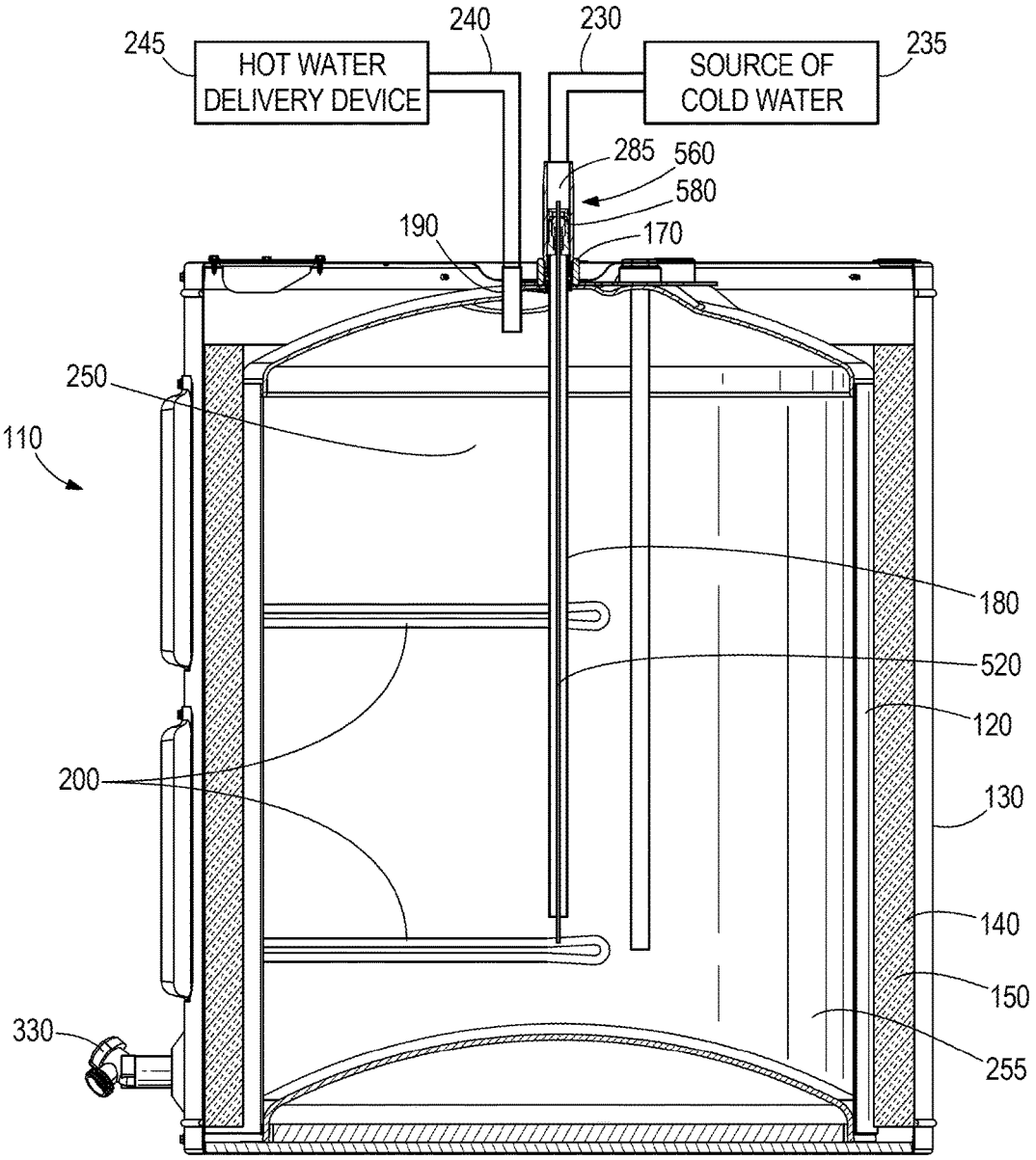
FIG. 3 is a cross-sectional view of a water heater incorporating a second configuration of a thermal expansion conduit according to the present invention.

FIG. 3 illustrates another configuration of the invention. All elements substantially similar to those in FIG. 1 are labeled with the same reference numbers. In this configuration, a thermal displacement conduit 520 extends through the dip tube 180. The thermal displacement conduit 520 is substantially contained in the dip tube 180. In the illustrated construction, the thermal displacement conduit 520 extends coaxially along the length of the dip tube 180. The thermal displacement conduit 520 extends a selected distance below the end of the dip tube 180.

Figure 4:
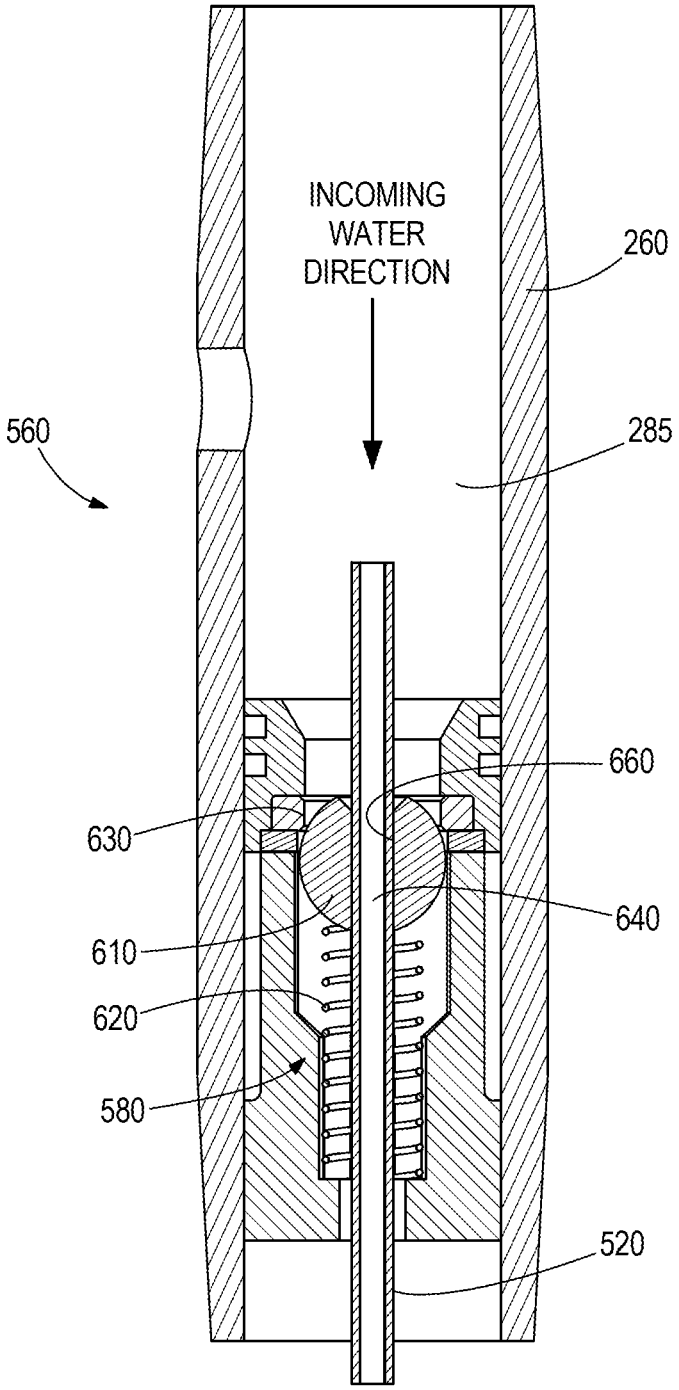
FIG. 4 is a cross-sectional view of a check valve assembly for use with the second expansion conduit configuration.

FIG. 4 illustrates a second configuration of an inlet assembly 560 for the configuration of FIG. 3. The inlet assembly 560 includes a check valve assembly 580 that includes a ball 610, and a main spring 620 biasing the ball 610 into engagement with a check valve seat 630. The top end of the thermal displacement conduit 520 extends through a through-bore 660 in the ball 610. The thermal displacement conduit 520 is fixed with respect to the ball 610, such that the thermal displacement conduit 520 moves up and down with the ball 610. In other configurations, the conduit 520 may be fixed with respect to the nipple 260 and dip tube 180 and the ball 610 may move linearly along the conduit 520. During a hot water draw, cold water flows through both the thermal displacement conduit 520 and the dip tube 180. During reheating of the water in the tank 120, water is thermally displaced through the thermal displacement conduit 520, through the ball 610, and into the receptacle space 285 above the check valve assembly 580. In this regard, the thermal displacement conduit 520 bypasses the check valve 580.

Because the thermal displacement conduit 520 in this configuration is within the tank 120, there will be some heat transfer from water in the tank 120 to water in the thermal displacement conduit 520, rendering this configuration less efficient to some degree compared to the first configuration with the external thermal displacement conduit 220. This configuration has the advantage of being entirely internal to tank 120, however, which may offset the loss of efficiency from the perspective of manufacturing, assembly, and installation. Additionally, this configuration is advantageous compared to known arrangements in which water is simply displaced out of the dip tube, because the thermal displacement conduit 520 is centered in the dip tube 180. Because the thermal displacement conduit 520 is centered in the dip tube 180, it is surrounded by water in the dip tube 180 that may be a few degrees cooler than the hot water in the upper portion 250 of the tank 120, so the heat loss through the thermal displacement conduit 520 is somewhat reduced. Although the thermal displacement conduit 520 is illustrated as centered or coaxial in the dip tube 180, it may be off-center and still enjoy this advantage as long as there is not significant contact between the thermal displacement conduit 520 and the dip tube 180 in the upper portion 250 of the tank 120. This configuration has the additional advantage (over known configurations in which water is simply displaced up the dip tube) of having the thermal displacement conduit 520 extend below the bottom of the dip tube 180, such that the thermal displacement conduit 520 is conducting water from very low in the tank, which is often cooler than the water at the end of the dip tube 180.

Figure 5:
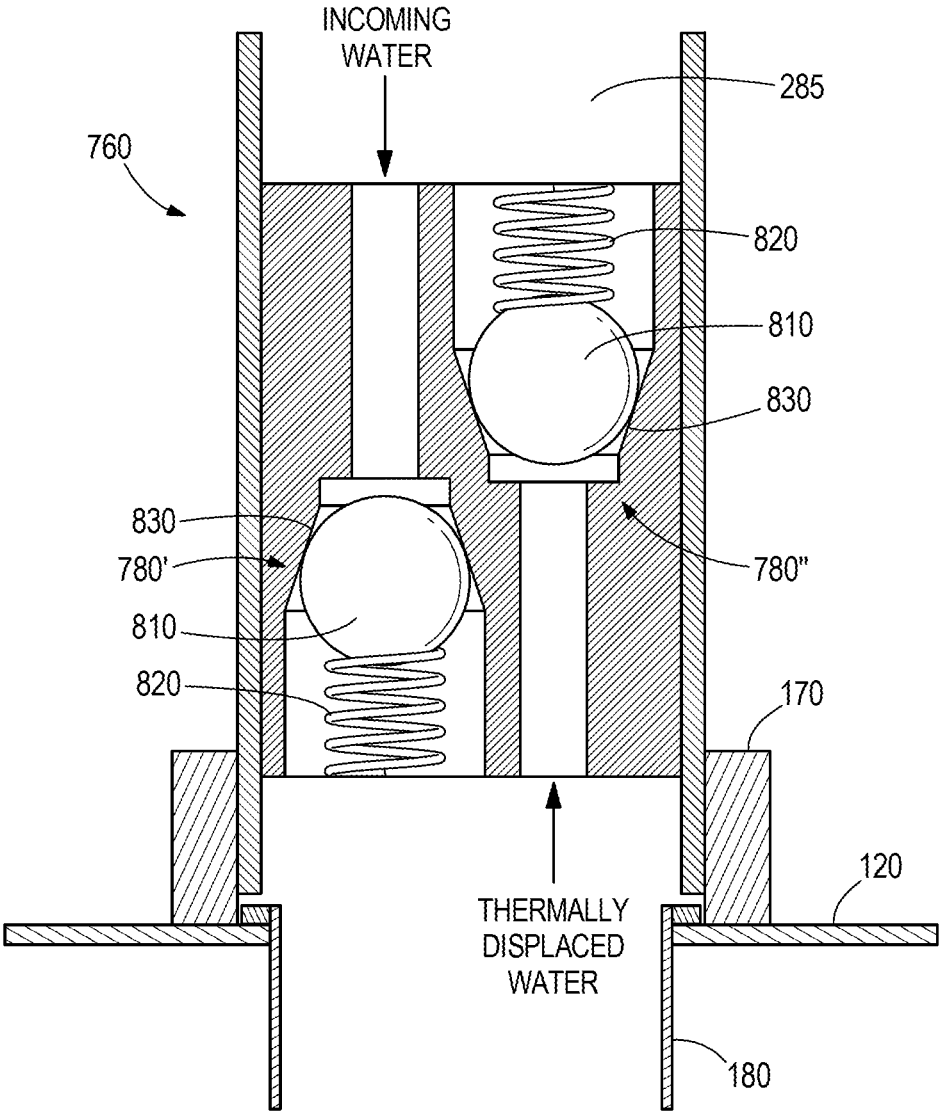
FIG. 5 is a cross-sectional view of a third check valve configuration.

FIG. 5 illustrates a third configuration of a water inlet assembly 760. This configuration includes first and second check valves 780', 780" which may be referred to collectively as a double check valve assembly 780. The double check valve assembly 780 may be constructed from a plastic block through which are drilled two parallel bores. Each bore is includes a narrow portion and a wide counter bore portion. fitted with one of the check valves 780', 780". The check valves 780', 780" operate in opposite directions. The first check valve 780' (on the left in FIG. 5) is for incoming cold water and a second check valve 780" (on the right in FIG. 5) is for thermally displaced water if the thermal expansion conduit 220 or 520 is blocked. Each check valve 780', 780" includes a ball 810, spring 820, and seat 830 which operate as discussed above with respect to the other check valve configurations. During a hot water draw, cold water flows into the tank 120 through the first check valve 780'. During thermal expansion of the water in the tank 120, normally the cold water at the bottom section will be expanded along the external thermal expansion conduit, but if that conduit is blocked, the water will expand up through the dip tube 180 and unseat the second check valve 780" so the water can escape to the receptacle space 285 as discussed above.

The check valves 780', 780" need not be identical, although they are roughly of equal size in the illustration. In fact, it may be desirable to make the first check valve 780' larger, to permit larger volumes of water to pass through it. It may also be desirable to use a stiffer spring 820 in the second check valve 780". The second check valve 780" should be calibrated so that it unseats at a pressure that is below a pressure that would activate a traditional pressure relief valve on the water tank 120.

Thus, the invention provides, among other things, a water heater having a thermal displacement conduit. Various features and advantages of the invention are set forth in the following claims.

What is claimed is:

1. A water heater comprising:

a tank containing water to be heated;

a cold water inlet for interfacing between a cold water supply pipe and the water tank for the supply of cold water to the tank;

a heat source for heating the water in the tank;

a receptacle; and a thermal displacement conduit communicating between a portion of the tank and the receptacle, such that water is displaced from the portion of the tank, through the conduit, to the receptacle during thermal expansion of the water during heating, wherein the tank includes a drain valve assembly for draining water from the tank, and wherein the thermal displacement conduit communicates between the drain valve assembly and the cold water inlet for delivery of displaced water from the drain valve assembly to the cold water inlet.

2. The water heater of claim 1, wherein the receptacle is a portion of the cold water inlet.

3. The water heater of claim 1, wherein the cold water inlet includes a check valve preventing water from displacing out of the tank through the cold water inlet.

4. The water heater of claim 1, wherein the heat source includes at least one electric heating element.

5. The water heater of claim 1, wherein the heat source includes a gas-fired burner.

6. The water heater of claim 1, wherein the portion of the tank is a lower portion of the tank and the water displaced by thermal expansion through the thermal displacement conduit is water from the lower portion of the tank.

7. The water heater of claim 1, wherein at least a portion of the thermal displacement conduit is outside of the tank.

8. The water heater of claim 1, further comprising a jacket around the tank, the jacket and tank defining therebetween an annular space; and a layer of insulation in the annular space; wherein at least a portion of the thermal displacement conduit is within the annular space.

9. The water heater of claim 1, further comprising a jacket around the tank, the jacket and tank defining therebetween an annular space; and a layer of insulation in the annular space; wherein the thermal displacement conduit is outside of the annular space and jacket.

10. A water heater comprising:

a tank containing water to be heated;

a cold water inlet for interfacing between a cold water supply pipe and the water tank for the supply of cold water to the tank;

a dip tube communicating at one end with the cold water inlet and having an opposite free end from which cold water is released into the tank;

a heat source for heating the water in the tank;

a receptacle outside of the tank; and a thermal displacement conduit communicating between a portion of the tank and the receptacle, such that water is displaced from the portion of the tank, through the conduit, to the receptacle during thermal expansion of the water during heating;

wherein the thermal displacement conduit is separate and distinct from the dip tube; and wherein the portion of the tank is lower than the free end of the dip tube.

11. The water heater of claim 10, wherein the thermal displacement conduit is substantially contained in the dip tube.

12. The water heater of claim 11, further comprising a check valve ball positioned in the cold water inlet; wherein the check valve ball includes a bore; wherein the thermal displacement conduit communicates with the bore; wherein the check valve ball permits water to flow into the tank from the cold water inlet but prevents water from flowing out of the tank through the cold water inlet except from the thermal displacement conduit.

13. The water heater of claim 11, wherein the dip tub and the thermal displacement conduit are coaxial, and wherein water in the dip tube surrounds the thermal displacement conduit to reduce heat loss through the thermal displacement conduit.

14. The water heater of claim 10, wherein water displaced to the receptacle flows back to the tank through the dip tube or the thermal displacement conduit when water is drawn from the tank.

15. The water heater of claim 10, wherein the cold water inlet includes a check valve for preventing water from flowing out of the tank through the cold water inlet during ordinary operation of the water heater; and wherein the thermal displacement conduit bypasses the check valve to displace water to the receptacle.

16. The water heater of claim 10, wherein the cold water inlet includes a check valve including a ball and a seat against which the ball sits to prevent flow of water from the tank through the cold water inlet during ordinary operation of the water heater; and wherein the thermal displacement conduit extends through the ball in the check valve to bypass the check valve.

17. The water heater of claim 10 wherein the thermal displacement conduit is external to the water tank.

18. A water heater comprising:

a tank containing water to be heated;

a cold water inlet for interfacing between a cold water supply pipe and the water tank for the supply of cold water to the tank;

a heat source for heating the water in the tank;

a receptacle;

a thermal displacement conduit communicating between a portion of the tank and the receptacle, such that water is displaced from the portion of the tank, through the conduit, to the receptacle during thermal expansion of the water during heating;

a jacket around the tank, the jacket and tank defining therebetween an annular space; and a layer of insulation in the annular space, wherein at least a portion of the thermal displacement conduit is within the annular space.

* * * * *